US009068124B2

(12) United States Patent
Spence et al.

(10) Patent No.: US 9,068,124 B2
(45) Date of Patent: Jun. 30, 2015

(54) POST-CONDITIONING OIL SAND SLURRY BLENDING FOR IMPROVED EXTRACTION PERFORMANCE

(71) Applicant: SYNCRUDE CANADA LTD. in trust for the owners of the Syncrude Project, Fort McMurray (CA)

(72) Inventors: Jonathan Spence, Edmonton (CA); Jun Long, Edmonton (CA); Robert Siy, Edmonton (CA); Samson Ng, Sherwood Park (CA)

(73) Assignee: SYNCRUDE CANADA LTD. In trust for the owners of the Syncrude Project as such owners exist now and in the future, Fort McMurray (CA)

( * ) Notice: Subject to any disclaimer, the term of this patent is extended or adjusted under 35 U.S.C. 154(b) by 343 days.

(21) Appl. No.: 13/852,477

(22) Filed: Mar. 28, 2013

(65) Prior Publication Data

US 2013/0256196 A1 Oct. 3, 2013

Related U.S. Application Data

(60) Provisional application No. 61/617,939, filed on Mar. 30, 2012.

(51) Int. Cl.
*C10G 1/04* (2006.01)
*C10G 1/00* (2006.01)

(52) U.S. Cl.
CPC ..... *C10G 1/047* (2013.01)

(58) Field of Classification Search
CPC ..... C10G 1/00; C10G 1/04; C10G 1/047
See application file for complete search history.

(56) References Cited

U.S. PATENT DOCUMENTS 4,474,616 A 10/1984 Smith et al.
4,776,949 A * 10/1988 Leung et al. ..... 208/390
2007/0289911 A1* 12/2007 Cymerman et al. ..... 210/195.1

FOREIGN PATENT DOCUMENTS

CA 1214421 12/1983

OTHER PUBLICATIONS

Bichard, J.A. Oil Sands Composition and Behavior Research. AOSTRA Technical Publication Series #4 (6-5 Behavior of Blends). 1987.
Schramm, L.L., et al. On the Processability of Mixtures of Oil Sands. AOSTRA Journal of Research. 1985. pp. 147-161. vol. 1(3).

* cited by examiner

*Primary Examiner* — Brian McCaig
(74) *Attorney, Agent, or Firm* — Bennett Jones LLP

(57) ABSTRACT

The invention is directed to a process for extracting bitumen from poor oil sand ore involving mixing the poor oil sand ore with heated water to produce a slurry, and conditioning the slurry to yield a poor ore stream. In a separate train, good oil sand ore is mixed with heated water to produce a slurry, and conditioned to yield a good ore stream. Both the conditioned poor ore and good ore streams are combined in specified proportions to yield a blended slurry which is then fed to a primary separation vessel to produce primary bitumen froth.

16 Claims, 3 Drawing Sheets

POST-CONDITIONING OIL SAND SLURRY BLENDING FOR IMPROVED EXTRACTION PERFORMANCE

FIELD OF THE INVENTION

The present invention relates generally to the field of oil sands processing, particularly to processes for extracting bitumen from poor oil sand ore.

BACKGROUND OF THE INVENTION

Oil sand generally comprises water-wet sand grains held together by a matrix of viscous heavy oil or bitumen. Bitumen is a complex and viscous mixture of large or heavy hydrocarbon molecules. The Athabasca oil sand deposits may be efficiently extracted by surface mining which involves shovel-and-truck operations (for example, mining shovels and hydraulic excavators). The mined oil sand is trucked to crushing stations for size reduction, and fed into slurry preparation units (such as tumblers, rotary breakers, mix-boxes, wet crushing assemblies, or cyclofeeders) where hot water and, optionally, process chemicals such as caustic are added to form an oil sand slurry. The oil sand slurry may be further conditioned by transporting it using a hydrotransport pipeline to a primary separation vessel (PSV) where the conditioned slurry is allowed to separate under quiescent conditions for a prescribed retention period into a top layer of bitumen froth, a middle layer of middlings (i.e., warm water, fines, residual bitumen), and a bottom layer of coarse tailings (i.e., warm water, coarse solids, residual bitumen).

"Fines" are particles such as fine quartz and other heavy minerals, colloidal clay or silt generally having any dimension less than about 44 μm. "Coarse solids" are solids generally having any dimension greater than about 44 Bitumen froth is treated to produce diluted bitumen which is further processed to produce synthetic crude oil and other valuable commodities.

Oil sand extraction typically involves processing ores which are relatively high in bitumen content and low in fines content. However, there exists an abundance of "poor ores" which alone yield poor bitumen recovery and consequently cannot be processed unless a high proportion of high-grade, good ores are blended into these dry ore feeds, "Poor ores" are oil sand ores generally having low bitumen content (about 6 to about 10 wt %) and/or high fines content (greater than about 30 wt %). In comparison, "good ores" are oil sand ores generally having high bitumen content (about 10 to about 12 wt % or higher) and/or low fines content (less than about 20 wt %).

Blending dry oil sands is a common practice. Ore blending criteria include limiting the fines content in the ore feed to specified maximum levels to prevent processability problems, thereby limiting the maximum proportion of problem ores in the blends. Poor ores may be dry blended with good ores to achieve a feed fines content of less than about 28 wt %. As an example, ore blending criteria may include limiting the fines content to about 28 wt %, and/or the transition ore to a fines content of about 15 wt %, to ensure acceptable bitumen recovery.

However, it is not always possible to meet blending criteria, particularly for day-to-day operations. Blending is currently conducted by mining ore from separate locations in the pit, and transporting and feeding separate truckloads of ore into the slurry preparation and hydrotransport/conditioning system. The disadvantages of the current practice include a limited amount of ore that can be fed from each shovel, the necessity for shovel moves to maintain acceptable blends, and reduced throughput when processing large amounts of poor ores. Ore blending activities thus significantly increase operating costs and reduce production capacity. Accordingly, there is a need in the art for improved methods of extracting bitumen from poor ores.

SUMMARY OF THE INVENTION

The present invention relates generally to processes of extracting bitumen from poor oil sand ore. In one aspect, the invention comprises a process for extracting bitumen from poor oil sand ore comprising:

mixing the poor oil sand ore with heated water to produce a first oil sand slurry, and conditioning the first oil sand slurry to yield a first conditioned stream;

separately mixing good oil sand ore with heated water to produce a second oil sand slurry, and conditioning the second oil sand slurry to yield a second conditioned stream;

combining the first and second conditioned streams in specified proportions to yield a blended slurry; and subjecting the resultant blended slurry to gravity separation in a primary separation vessel to produce primary bitumen froth.

In one embodiment, the process further comprises crushing each of the poor and good oil sand ores before mixing with water.

In one embodiment, the proportion of the first conditioned stream ranges between about 15 wt % to about 30 wt % within the blended slurry.

In one embodiment, the first and second oil sand slurries are prepared in a tumbler, rotary breaker, mix-box, wet crushing assembly, or cyclofeeder. In one embodiment, conditioning is conducted in a hydrotransport pipeline or tumbler. In one embodiment, blending is conducted in a superpot, pump-box, tumbler or pipe junction.

Additional aspects and advantages of the present invention will be apparent in view of the description, which follows. It should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will now be described by way of an exemplary embodiment with reference to the accompanying simplified, diagrammatic, not-to-scale drawings.

DETAILED DESCRIPTION OF PREFERRED EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practised without these specific details.

Figure 1:
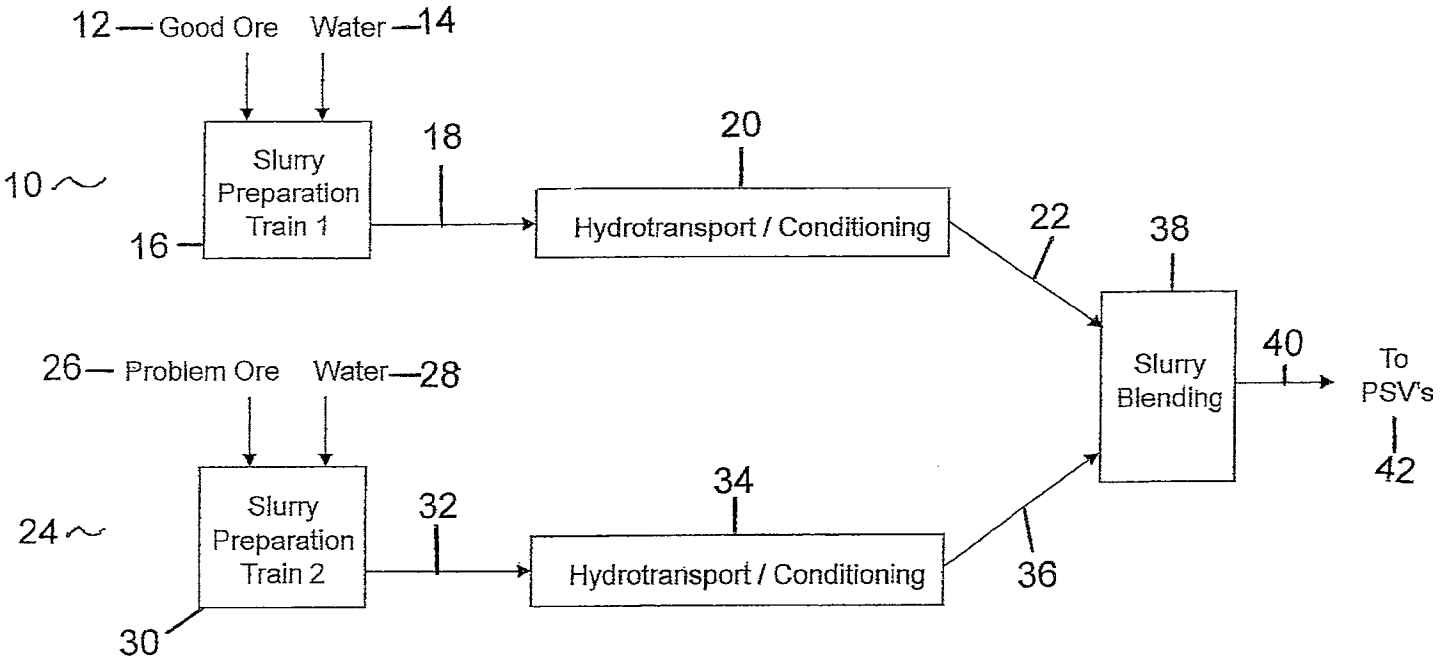
FIG. 1 is a schematic of one embodiment of the present invention for slurry blending conditioned poor and good ores.

The present invention relates generally to a process for extracting bitumen from poor oil sand ore by blending poor and good oil sand slurries after each ore has been separately conditioned. FIG. 1 is a schematic of one embodiment of the process of the present invention. The process generally involves two separate mine trains. As used herein, the term "mine train" refers to a process for crushing and mixing the oil sands with heated water to facilitate the extraction of bitumen.

The first train (10) involves the treatment of good oil sand ore (12). As used herein, the term "good ore" refers to oil sand ore generally having a high bitumen content (about 10-12 wt % or greater) and/or low fines content (less than about 25 wt %, preferably less than about 20 wt %). The good ore (12) is mined from a rich oil sand area and crushed in a crusher (not shown, but typically comprises two rollers) to break up large chunks of the ore after it has been mined. The good ore (12) is then mixed with heated water (14) in a slurry preparation unit (16). The slurry preparation unit (16) may comprise a tumbler, screening device, and pump box; however, it is understood that any slurry preparation unit known in the art can be used, including a rotary breaker, mix-box, wet crushing assembly, or cyclofeeder. The oil sand slurry may then be screened through a screening device (not shown), where additional water may be added to clean the rejects (e.g., oversized rocks) prior to delivering the rejects to rejects pile. The screened oil sand slurry is collected in a vessel such as a pump box where the oil sand slurry (18) is then pumped through a hydrotransport pipeline (20). The hydrotransport pipeline (20) comprises a pipeline designed to carry oil sand slurry (18) from slurry preparation facilities to extraction facilities. The pipeline (20) is of an adequate length to ensure sufficient conditioning of the good ore oil sand slurry (18) for example, through digestion/ablation/dispersion of the larger oil sand lumps, coalescence of released bitumen flecks and aeration of the coalesced bitumen droplets. Alternatively, a tumbler may serve as an effective unit to yield a conditioned good ore stream (22).

The second train (24) involves the treatment of poor oil sand ore (26). As used herein, the term "poor ore" generally refers to oil sand ore having a low bitumen content (8-10 wt %) and/or high fines content (greater than about 28 wt %). Similar to the above treatment of the mined good ore (12), the poor ore (26) is mined, crushed, and mixed with heated water (28) in a separate slurry preparation unit (30). The oil sand slurry (32) may then be screened through a screening device (not shown), and collected in a vessel such as a pump box where the oil sand slurry (32) is then pumped through a separate hydrotransport pipeline (34) or into a tumbler to ensure sufficient conditioning of the poor oil sand slurry (32) to yield a conditioned poor ore stream (36).

After conditioning has been completed in each of the separate trains (10, 24), the good oil sand stream (22) and poor oil sand stream (36) are combined in specified proportions in a blending vessel (38) to yield a blended slurry (40). In one embodiment, the proportion of poor ore stream (36) ranges between about 15 wt % to about 30 wt % within the blended slurry (40). Suitable blending vessels (38) include, but are not limited to, a superpot, pump box, tumbler, or pipe junction. The blending vessel (38) receives and mixes the slurry streams (22, 36) together from the two separate trains (10, 24), and distributes the resultant blended slurry (40) to one or more primary separation vessels (42). The blended slurry (40) is retained in the primary separation vessels (42) under quiescent conditions for a prescribed retention period to produce bitumen froth, middlings and wet tailings. The bitumen froth, middlings and wet tailings are separately withdrawn and further processed.

As described in Example 1, the results from an experimental run indicate that such post-conditioning slurry blending produces a primary bitumen recovery equivalent to or better than dry blending, and significantly better than blending slurries prior to conditioning. Post-conditioning slurry blending provides an alternative method to dry blending to improve the processing of poor ores.

Exemplary embodiments of the present invention are described in the following Example, which is set forth to aid in the understanding of the invention, and should not be construed to limit in any way the scope of the invention as defined in the claims which follow thereafter.

EXAMPLE 1

An experimental run was conducted to compare the extraction performance of no ore blending, dry ore blending, post-conditioning slurry blending and pre-conditioning slurry blending. Individual ore processability and dry blending were studied using two pilot plants in operation, the primary pilot plant #1 with a 10 kg/hour oil sand feed system, and the second pilot plant #2 with a larger feed rate. To enable slurry blending process, pilot plants #1 and #2 were operated simultaneously, with a slipstream of slurry from the pilot plant #2 being fed to the pilot plant #1 for the slurry blending. The first set of blending tests was conducted with a poor ore (designated as "AJ") and a good ore (designated as "AL"). A second set of blending tests was conducted with a poor ore (designated as "MA") blended with good ore AL. Table 1 summarizes the properties of these ores.

TABLE 1

Properties of Selected Problem and Good Ores

| Ore Designation | AJ Poor Ore | MA Poor Ore | AL Good Ore |
|---|---|---|---|
| Bitumen, wt % | 6.7 | 8.5 | 11.9 |
| Fines, wt % < 44 μm | 49 | 40 | 23 |

Figure 2:
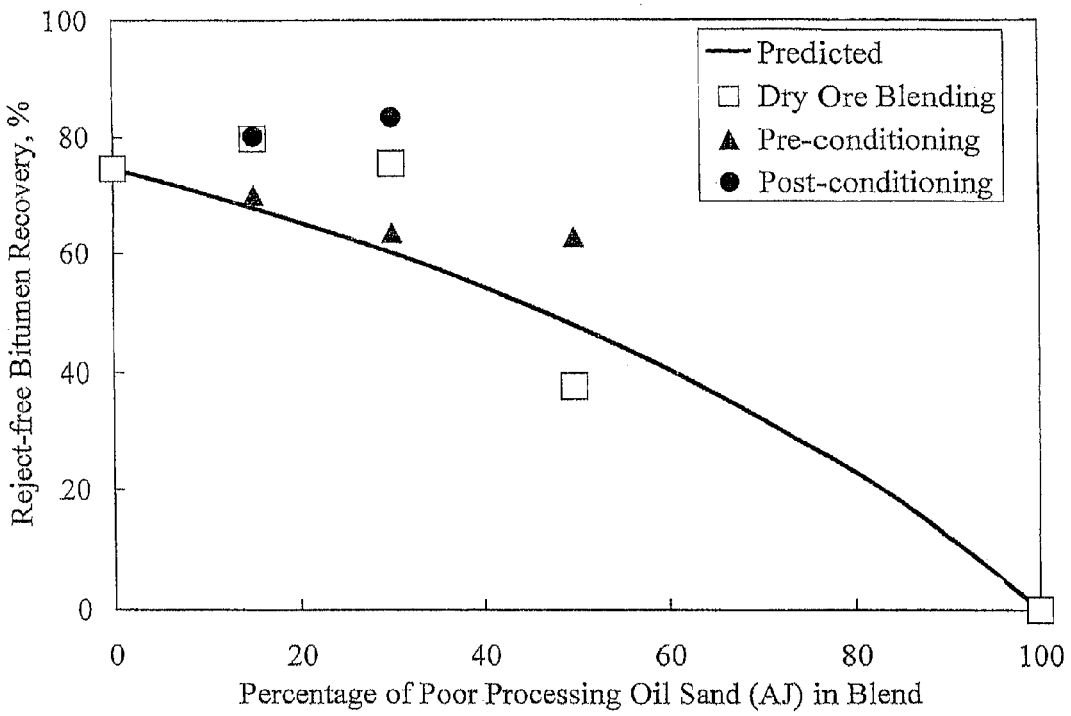
FIG. 2 is a graph showing the reject-free bitumen recovery (expressed as percentage) versus the amount of poor processing oil sand ("AJ") in the poor ore/good ore blend (expressed as percentage).

In the first test, poor ore AJ had a bitumen recovery of 0% when processed alone, while good ore AL had a reject-free bitumen recovery of 75% when processed alone. FIG. 2 shows the results of the different blending scenarios. A plot of the predicted bitumen recovery was determined by calculating a bitumen recovery as a percentage of the recovery of each individual ore in the blend, and is included in FIG. 2. Prior to testing, it had been anticipated that pre-conditioning slurry blending would achieve the best performance of the two slurry blending options; however, it was surprisingly discovered that post-conditioning slurry blending achieved bitumen recoveries equivalent to or better than dry ore blending at blend percentages of 15 wt % and 30 wt % poor ore. In particular, at 30 wt % blending of poor ore, the recovery of bitumen with post-conditioning blending was about 84% versus about 63% with pre-conditioning blending and about 77% with dry ore blending.

Figure 3:
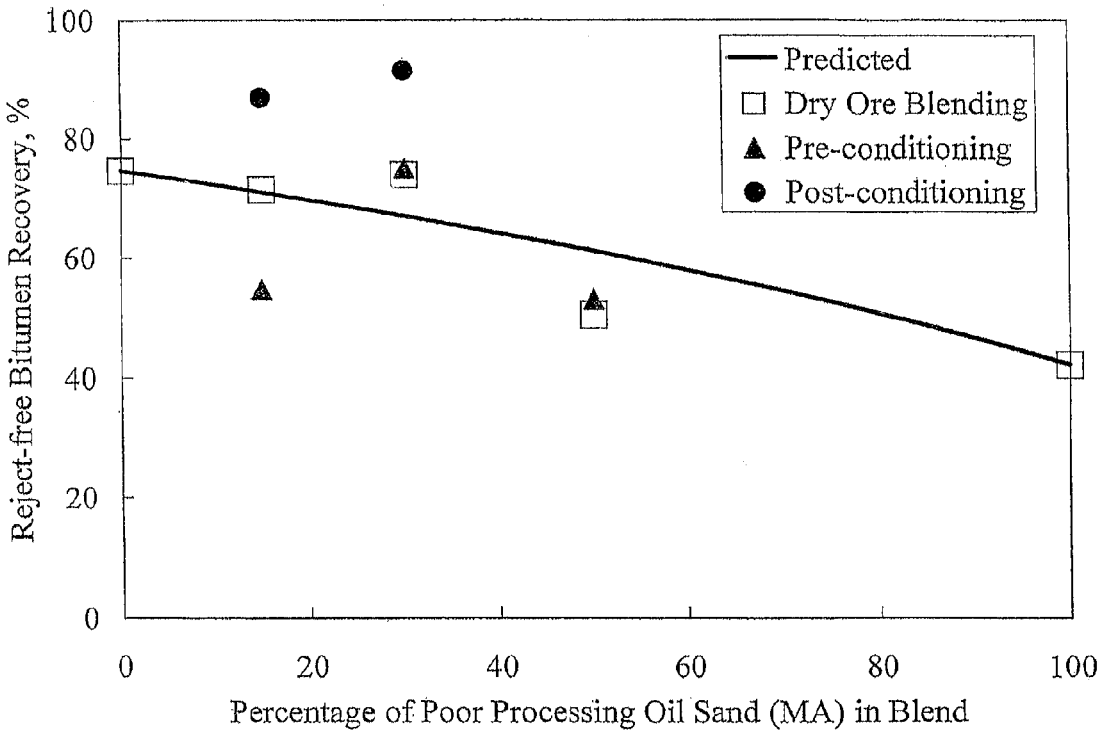
FIG. 3 is a graph showing the reject-free bitumen recovery (expressed as percentage) versus the amount of poor processing oil sand ("MA") in the poor ore/good ore blend (expressed as percentage).

In the second set of tests, the poor ore MA achieved a bitumen recovery of only 42% when processed alone. The good ore AL achieved a bitumen recovery of 75% when processed alone. Poor ore MA was blended with good ore AL and FIG. 3 show the results of the three different blending scenarios. The bitumen recovery achieved by post-conditioning slurry blending was better at blending percentages of 15 wt % and 30 wt % poor ore than the bitumen recovery observed with dry ore blending or pre-conditioning slurry blending. In particular, at 30 wt % blending of poor ore, the recovery of bitumen with post-conditioning blending was about 92% versus about 84% with pre-conditioning blending and about 84% with dry ore blending.

In summary, the above results suggest that post-conditioning slurry blending may be preferable over dry blending to improve the processing of poor ores.

From the foregoing description, one skilled in the art can easily ascertain the essential characteristics of this invention, and without departing from the spirit and scope thereof, can make various changes and modifications of the invention to adapt it to various usages and conditions. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

References

The following references are incorporated herein by reference (where permitted) as if reproduced in their entirety. All references are indicative of the level of skill of those skilled in the art to which this invention pertains.

Bichard, J. A. (1987) Oil sands composition and behavior research, AOSTRA Technical Publication Series #4 (6-5 Behaviour of Blends).

Schramm, L. L., Russell, G. S. and Stone, J. A. (1985) On the processability of mixtures of oil sands. AOSTRA Journal of Research 1(3):147-161.

What is claimed is:

1. A process for extracting bitumen from poor oil sand ore comprising:

mixing the poor oil sand ore with heated water to produce a first oil sand slurry, and conditioning the first oil sand slurry to yield a first conditioned stream;

separately mixing good oil sand ore with heated water to produce a second oil sand slurry, and conditioning the second oil sand slurry to yield a second conditioned stream;

combining the first and second conditioned streams in specified proportions to yield a blended slurry; and subjecting the resultant blended slurry to gravity separation in a primary separation vessel to produce primary bitumen froth.

2. The process of claim 1, further comprising separately crushing each of the poor and good oil sand ores before each ore is mixed with water.

3. The process of claim 2, wherein the proportion of the first conditioned stream ranges between about 15 wt % to about 30 wt % within the blended slurry.

4. The process of claim 3, wherein conditioning of the first or second oil sand slurries or both is conducted in a hydrotransport pipeline or tumbler.

5. The process of claim 3, wherein combining is conducted in a superpot, pump-box, tumbler, or pipe junction.

6. The process of claim 2, wherein the first and second oil sand slurries are prepared in a tumbler, rotary breaker, mix-box, wet crushing assembly, or cyclofeeder.

7. The process of claim 2, wherein conditioning of the first or second oil sand slurries or both is conducted in a hydrotransport pipeline or tumbler.

8. The process of claim 2, wherein combining is conducted in a superpot, pump-box, tumbler, or pipe junction.

9. The process of claim 1, wherein the proportion of the first conditioned stream ranges between about 15 wt % to about 30 wt % within the blended slurry.

10. The process of claim 9, wherein the first and second oil sand slurries are prepared in a tumbler, rotary breaker, mix-box, wet crushing assembly, or cyclofeeder.

11. The process of claim 9, wherein conditioning of the first or second oil sand slurries or both is conducted in a hydrotransport pipeline or tumbler.

12. The process of claim 9, wherein combining is conducted in a superpot, pump-box, tumbler, or pipe junction.

13. The process of claim 1, wherein the first and second oil sand slurries are prepared in a tumbler, rotary breaker, mix-box, wet crushing assembly, or cyclofeeder.

14. The process of claim 13, wherein combining is conducted in a superpot, pump-box, tumbler, or pipe junction.

15. The process of claim 1, wherein conditioning of the first or second oil sand slurries or both is conducted in a hydrotransport pipeline or tumbler.

16. The process of claim 1, wherein combining is conducted in a superpot, pump-box, tumbler, or pipe junction.

* * * * *